US005295339A

United States Patent [19]

Manner

[11] Patent Number: 5,295,339

[45] Date of Patent: Mar. 22, 1994

[54] SIMULATED INDIVIDUAL SELF-VENTING OVERLAPPING PLASTIC SHAKE

[75] Inventor: Warren R. Manner, Omaha, Nebr.

[73] Assignee: Manner Value Plastic, Inc., Omaha, Nebr.

[21] Appl. No.: 926,946

[22] Filed: Aug. 10, 1992

[51] Int. Cl.[5] ..... E04D 1/08; E04D 1/18

[52] U.S. Cl. ..... 52/518; 52/313; 52/533; 52/558; 52/556

[58] Field of Search ..... 52/533, 558, 560, 555, 52/313, 546, 556, 518

[56] References Cited

U.S. PATENT DOCUMENTS

| | | | |
|---|---|---|---|
| 368,386 | 8/1887 | Donaldson | 52/533 |
| 1,266,137 | 5/1918 | Melde | 52/533 |
| 3,852,934 | 12/1974 | Kirkhuff | 52/555 |
| 4,290,248 | 9/1981 | Kemerer et al. | 52/558 |
| 4,598,522 | 7/1986 | Hoofe | 52/555 |

*Primary Examiner*—James L. Ridgill, Jr.
*Attorney, Agent, or Firm*—John A. Beehner

[57] ABSTRACT

A simulated shake shingle for replicating the random appearance of natural wood shakes is provided, the shingle including a generally rectangular top plate having forward and rearward ends, the top plate being rearwardly tapered. A generally rectangular bottom plate is also provided, being secured and partially underlying the top plate and being rearwardly and transversely offset therefrom. The bottom plate is of a size and shape for flush engagement against a flat roof surface and is adapted for side to side engagement with bottom plates of six identical adjoining shingles positioned with the top plates thereof in adjacent nonoverlapping relation. The shingle may also include a plurality of venturi grooves formed on the underside thereof for forming an air insulating barrier to reduce heating or cooling loses from a building interior through the roof.

10 Claims, 2 Drawing Sheets

SIMULATED INDIVIDUAL SELF-VENTING OVERLAPPING PLASTIC SHAKE

BACKGROUND OF THE INVENTION

1. Technical Field

The invention relates to a novel approach to a roofing system using individual pieces of varying size simulated wood shakes, shingles or riles. It also relates to a novel composition of material composed of thermoplastic and additives improving its usefulness as a construction surfacing. It further relates to a novel design for improved performance as a roofing membrane, siding and decorative interior surfacing.

This invention is intended to provide for the use of low grade, off-specification, contaminated and/or commingled post consumer or industrial scrap plastic which can be recycled for extended service life as a molded, simulated, preferably split cedar, wood shake. Plastic consumption continues to increase and is becoming more of an issue with environmentalists, and federal, state and local governments. The reduction of available landfills and depletion of our natural resources, including oil and gas for plastic and trees for shake production, can be reduced by the successful reuse of thermoplastics recycled and converted to a second and third long term useful product. The intent and design of this invention is to provide for the manufacture of simulated plastic shakes, shingles and tiles derived from scrap plastic.

The problems with continuing to use forest products for shake and shingle production are depletion of resources and the inherent flaws of wood as a roofing material. Wood shakes do not provide for a good permanent edge seal. Wood shakes are subject to breaking when impacted, such as during a hail storm. Wood shakes do deteriorate with time. Wood shakes change color, turn moldy and are not fire proof.

The intent of this invention is to use scrap plastic molded into a simulated shake to overcome the deficiencies inherent with wood, thus reducing the depletion of our forests and reducing the amount of plastic scrap deposited in our landfills. This invention creates a profile surface similar to wood shakes with grain, knots and raised and grooved outer surfaces, providing the visual effect, through numerous patterns and sizes, of wood shakes. Being a molded product, the bottom or underside will be flat thus mating the substrate surface better than the rough underside of natural shakes. The underside of the molded shake will have lateral grooves equidistant apart forming a venturi area. This invention, being a molded product, will have one or more overlap areas with weather seal features, thus greatly improving the edge seal compared to wood shakes. This invention, manufactured from plastic, will improve the impact resistance of the shake roofing over wood or asphalt materials thus reducing the frequency of repair or replacement of damaged roofing by hail and winds. This invention, being plastic, is virtually non-degradable verses wood and asphalt. Additives can be incorporated into the plastic shake such as color stabilizers and ultraviolet inhibitors for extended service life. Other additives are fungicides, if necessary, and fire retardant to such a level that the plastic will not promote a flame. Other additives such as organic fillers or foaming agents could be added to reduce or increase the shake weight and fibers can add to the strength of the plastic shake.

This invention and novel design will replace wood shakes without requiring skilled labor to install it. This invention with its uniform, interlocking, overlapping, individual part design will only require a laborer skilled in conventional construction procedures. Special tools, such as such as splitting axes, are not needed because a common hammer, stapler and saws are used the same as with wood.

The utility of this manufactured shake from scrap plastic thus will reduce plastic going to landfills and extend the useful life of the plastic. The rigidity of this plastic shake will replace wood and asphalt products thus reducing the demand for wood products from our forests and oil for asphalt.

The term "Shake", embodied herein, will refer to commonly recognized terms such as wooden shake, shingle, slate or tile and can substitute the term shake where printed. Additionally the term "Surfacing" will be used to refer to exterior roofing, siding and decorations and also to interior wall decorative construction applications.

2. Description of the Prior Art

This invention relates particularly to simulated wood shake, shingle and tile surfacing used for roofing, siding and decoration. Cedar shakes have a natural attractiveness as a roofing and siding material and have been used for years. Unfortunately, the shakes are expensive and require experienced labor to install. Cedar shakes are obtained from a diminishing forest supply. Wooden shakes do not provide for a good weather seal at abutting joints, instead multiple layers overlapped to achieve a weatherproof surface. Wooden shakes deteriorate requiring a treatment with preservative every 3 to 5 years. Additionally, wooden shakes are fragile and can be damaged, particularly by hail, and have little or no fire rating, which makes it a greater insurance risk and forces higher insurance premiums for the owners of shake surfaced structures.

The above flaws in wooden shakes have given rise to a number of manmade synthetic simulated shakes. The body of art, simulating shakes, are make from materials such as cement, asbestos composition, Fiberglass, aluminum, galvanized steel and sophisticated expensive engineered thermoplastics.

Prior art simulated shingles suffer from one or more design or manufacturing deficiencies. The desired aesthetics of individual natural shake roof or siding can not be duplicated by simulated panel construction. In an attempt to reduce high labor cost involved in wooden shake installation, expensive simulated wood shake panels are manufactured for easier labor installation. Unfortunately, the panels referred to herein do present a repetitive pattern thus never duplicating individual varying size shakes.

The following patents and commercial products all have the same design and manufacturing deficiency. All, heretofore prior art, products are of a paneled construction, repeating the decorative surface. The prior art varies from each other only by size (length, height, thickness), materials used in the manufacturing thereof, fastening methods for installation and weather sealing of joint areas.

Commercially available products, to date, are all panel designs. One is a press formed asphalt with the addition of metal spacers and fastener clips. Another is a structural foam panel coated with a sheet or film of ultraviolet stability. Still another is a stamp formed plastic sheet with a heavy surface design but still it has a repetitive pattern. Yet another plastic roof panel is infection molded from an expensive engineered plastic resin and although it is reported to be able to injection mold this panel with recycled industrial plastic scrap, secondary treatment of painting, for color, and a ultraviolet coating must be applied to make this product weatherproof in exterior roof applications.

U.S. Pat. No. 4,610,902 is a bitumen material, an inexpensive acceptable construction material but the manufacturing process includes the step of laminating a film to both surfaces thus introducing a second manufacturing process and possible bond failure between the dissimilar materials. The corrugated surface design is desirable for this patent but reference is made therein of simulated wood shake patterns which would be repetitive.

U.S. Pat. No. 4,603,529 is a long rectangular wedge shaped panel with an interlocking longitudinal strip and corresponding groove. This patent is definitely a repeating pattern panel and requires a felt between courses to weather seal butt joints, which is not standard construction practice.

U.S. Pat. No. 4,598,522 claims it can be manufactured from plastic by injection molding and vacuum forming although vacuum forming requires a secondary forming process to produce interlocking hold down tabs. It is proposed as a panel which would result in a repeating pattern.

U.S. Pat. No. 4,015,391 claims to be a molded panel with a hollow air space underneath the panel to form the tapered design of a shake. The air space is reinforced with random structural ribbing to support the panel. This patent presents the most natural simulation of cedar shake appearance in the design of irregular leading edge design treatment by having one or more of the shake patterns, in the panel, extend further over the overlapping panel course but it is still a panel with repeating patterns.

SUMMARY OF THE INVENTION

The simulated individual self-venting overlapping plastic shake roofing and/or siding parts, disclosed in various forms within this invention, eliminate the repetitive design of prior art construction, replicate the natural random pattern of wooden shakes, improve the durability of roofing membranes and facilitate easy labor installation. The individual shake parts are of varying width and length. Each shake part is formed, or molded, with one or more varied surface heights and decorative designs such as wood grain, clay tile or slate elements.

The exposed area of the shake surface is a general wedge profile top plate wherein the leading edge is thicker and the profile tapers to the far most portion of the textured surface area. Extending beyond the upper textured surface is a non-textured first underlap surface, this surface is also used to fasten the shake, by nails or staples, to the roof or wall substrate. To one side of the textured surface, running nearly full length of the shake, is another intrinsic second underlap surface. The two underlap surfaces correspond to relieved areas on the underside of the shake part which becomes the overlapping area. The first underlap fits and butts with the subsequent overlap shake course above it. The second underlap along the side of the shake fits and butts with the adjoining overlap shake to the side of it. The second underlap is integrally molded with one or more longitudinal ribs which mesh with corresponding grooves in the underside of the second overlap.

The ribs and grooves prevent wicking action of moisture and direct heavier water flow down and out to the next lower surface. The ribs can be modified for a snap fit into the corresponding modified groove thus forming a locator and weather strip. The ribs can be substituted with a relief area filled with mastic sealant adhering to both the underlap and overlap when installed. Intricately connected to the underlap area at the leading edge and near the weather seal ribs is a weather overlap tab. The weather overlap tab will cover butt joints in this area and form a weather seal.

An integral function and design feature of this invention are the venturi grooves molded into the back of the shake part. The venturi grooves, of a constant width, are longitudinal and spaced equal distance apart. The venturi grooves are located only in the bottom plate, not in the overlap relief. This bottom plate makes full contact with the roof or wall substrate surface. The venturi grooves being of equal distance and width apart will match or align with venturi grooves in subsequent shake courses as they are installed. Each shake part is sized to accomplish the alignment of the venturi grooves.

The venturi grooves of this invention will result in an air passage from the edge or eve of a roof to the peak or ridge. The venturi air passage will create air currents under the shake surface. As air in the venturi is heated physically, the air will rise. The heated air, restricted by the venturi, will rise and have to exit at the ridge. The rapid movement of the restricted air will force the suction replacement of cooler external air into the venturi at the bottom edge or eve of said roof. This rapid air movement, under the shake surface and above the roof substrate, thus creates a insulating factor to this invention. This insulation features removes heated air from the roof surface before the heat can penetrate to the structure attic. Air, being a relatively good insulator in itself, will also work in the reverse during inclement winter conditions. The heat penetrating the substrate of the roof from the attic will create an insulating air blanket expelling heated air at the ridge not allowing the heat to penetrate to the shake surface thus not melting snow and helping to prevent subsequent forming of ice that could potentially cause damage to the roof membrane.

Another object of the invention is to manufacture solid plastic shake parts economically. The individual shake parts incorporating the designs herein can best be produced by injection molding although those knowledgeable in the art could blow mold or rotationally mold hollow single parts. Also vacuum forming, compression forming or injection molding of more than one piece of a shake could result in a single shake part by assembling the pieces in a secondary operation. Additionally the hollow shake parts could be left un-filled or could be filled with insulating foam material. All arts of manufacturing result in a individual shake part which is the intent of this invention. Variations to a solid plastic shake part will be disclosed within this invention.

A solid plastic shake part to be manufactured economically must utilize an inexpensive grade of plastic. It is therefore proposed to use post consumer recycled plastic derived and secured from the solid waste stream. The post consumer plastic, utilized in this invention, can be derived from any of the following plastic types normally referred to as commodity grades, although engineered grades would also produce the desired shake part but the latter being normally more expensive. The commodity grade post consumer plastics utilized in this solid shake part could be one or more of the following: high density polyethylene (HDPE), low density polyethylene (LDPE), polypropylene (PP), polyethylene terephthalate (PET), polystyrene (PS), polyvinyl chloride (PVC) and/or other future resins as they become available. The resin types can be either homopolymers, copolymers or blends of each and commingled resins. The infrastructure of post consumer collection and processing of these recycled plastics is the basis of economically available resins to produce a solid plastic shake part.

A further object of this invention is to manufacture a shake part with durability features not requiring secondary preparations and with physical features desirous to the application. The shake parts, being plastic, greatly excel in durability over wood and asphalt shakes, an example being able to withstand physical abuse, such as hail damage, without breaking and splitting. Thermal expansion and contraction can be controlled by mixing additives to the plastic. Mineral and chemical additives mixed into the plastic resin are thoroughly impregnated and disbursed through out the shake part through the melting, mixing and injection molding process. A large selection and varying amounts of additives can be incorporated and homogenized into the shake part during injection molding that could not be accomplished in the processing of panel simulated shake patents referred to herein. Examples of durability features that can be accomplished during injection molding, with additives, are ultraviolet stabilizers, variety of colors, impact modifiers, fiber fillers for strength and a very important additive would be a fire retardant to improve the fire resistance of the shake. Additional additives can be incorporated into the plastic to alter the physical features of the shake. An example of physical changes would be adding a blowing agent which creates air bubbles in the core of the shake part thus reducing the amount of plastic needed in the part and producing a lighter weight part. The blowing agent air bubbles remain in the core of the part and do not affect the exterior surface or shell of the shake part therefore there are no bubble pockets or surface voids in the parts. When desired, organic additives will be mixed into the plastic to increase the weight of the shake part.

An additional object of this invention is to produce individual shake parts each being of varying width, length and textured surface, installed in a random selection configuration to provide an attractive non-repeating simulated shake surfacing. To achieve a non-repeating pattern a multiple of five or more dissimilar surface textures of varying ridges and valleys are needed when a constant width part is produced for simulated shingles. To insure an even greater degree of non-repetitiveness a multiple of five or more variations in part width and length along with dissimilar surface textures will provide the desired appearance of split cedar shakes of slate tiles. When varying the width of the shake parts care will be taken not to affect the venturi alignment on the back of the parts, the venturi being an integral design feature of this invention.

Still another object of the individual plastic shake invention is to provide for a overlap, underlap design. The overlap will provide a weather seal and the corresponding butt joints will facilitate correct alignment, concealment of the underlap, and provide for rapid installation. The object of rapid installation is accomplished without specialized tool or expensive labor. Standard tools such as hammers and stapling equipment are used to fasten the shake parts to the substrate with nails or staples. Standard tools such as saws and shears may be needed for a minimum of applications and these tools will easily cut the subject plastic shake parts. Experienced labor will not be necessary to install the individual shake parts. The manufactured part with intrinsically molded overlap and butt joint is simply installed by the laborer fitting and fastening the courses of shakes using conventional construction practices. Each individual shake is butt joined at the overlap engaging the longitudinal ridges and grooves molded into each part. If a mastic seal is provided in the overlap, the laborer simply removes the protective shipping tape before installing the next shake. Installing the second and subsequent courses requires the laborer to butt join the overlap of the upper shake to the lower shake course. The adjacent shake part will nest into a double overlap to one side and below. The only precaution a laborer should observe is to stagger the seams, this will improve weatherability and provide for the random appearance of cedar shakes. Additionally, the sizing or fitting of individual solid pieces for inside corners, outside corners and ridge caps can be accomplished by using hand or power saws or shears. When cutting the appropriate angles for inside corners, the cutting of solid shake parts will not expose a cavity, inherent in panel manufactured products, thus a solid edge is exposed when cut. To produce an outside corner or ridge cap using the solid individual shake, a single size shake part could be used or a larger shake part could be cut to size, thus varying the surface design of different parts, and standard construction practices of overlapping and butting parts will form the desired weather cap.

The invention described herein can also apply to individual shakes connected to each other to form a panel or continuous row. The invention can also include varying designs of venturi grooves, such as serpentine, fluted or beveled designs. The invention may also exclude the venturi grooves. The invention can be manufactured from various materials, other than plastic, such as Fiberglass, composites or mineral based materials. The invention is to provide a roofing, siding and decorative surfacing of individual manufactured parts using conventional equipment and know-how. The plastic material is presently available in quantity and the parts can be fabricated in a large variety of colors, sizes and textured surfaces.

Additional objectives and advantages of the invention will become apparent to those knowledgeable in the arts during the following description and detailing of the accompanying drawings.

DESCRIPTION OF THE PREFERRED EMBODIMENT

Figure 1:
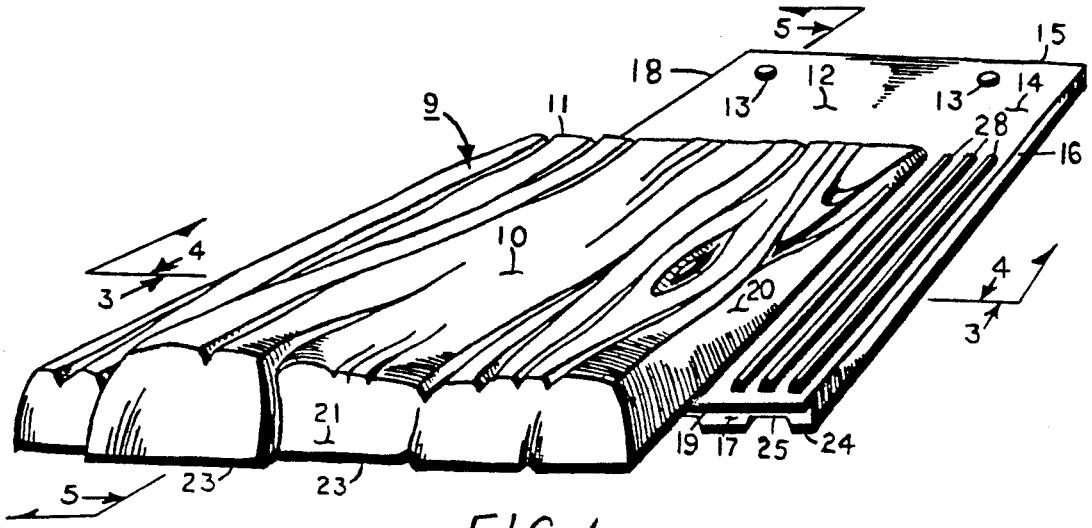
FIG. 1 is a perspective view of an individual plastic shake with a textured surface and underlap area with weather strip ribs.
Figure 5:
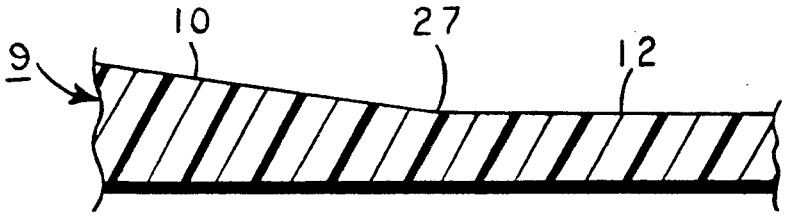
FIG. 5 is a false sectional view of an individual plastic shake where the transition between the textured surface and the underlap has no raised butt joint.

Referring to FIG. 1, a perspective view of an individual plastic shake 9, a typical individual shake part 9 is comprised of a textured top plate 10, a first underlap surface 12, and a second underlap 14. The textured top plate 10 incorporates various patterns of ridges and valleys to simulate wood or raised and relieved areas to simulate tile or slate surfaces. Top plate 10 varies in width and corresponding area 12 varies proportionately in width to top plate 10. Area 14 does not change regardless of top plate 10 width change. Textured top plate 10 is the most visual portion of the invention and varying the width of top plate 10 and changing the texture of subsequent shake part sizes reduces the repetitive pattern tendencies when installed on a structure surface. Top plate 10 of part 9 is tapered from front wall 21 to rear 11, the taper is further illustrated in the profile of the sides, number 20. Exposed front 21 profile will vary according to the texture of 10 and will also vary in protrusions 23. Rear wall 11 of top plate 10 may be raised slightly or may terminate flush as shown in FIG. 5 at point 27, thus replacing number 11.

First surface 12 is the fastening area of the invented shake part 9. Fastener 13 is driven through surface 12 into the substrated surface. Fastener 13 can be either a nail, screw or staple. First underlap surface 12 is subsequently covered by a first mating overlap surface 22, FIG. 2, when the next row or course is installed.

The second underlap surface 14 of a side adjacent shingle 15 is covered by a second mating overlap surface 42 which is adjacent the first mating overlap surface 22.

Figure 3:
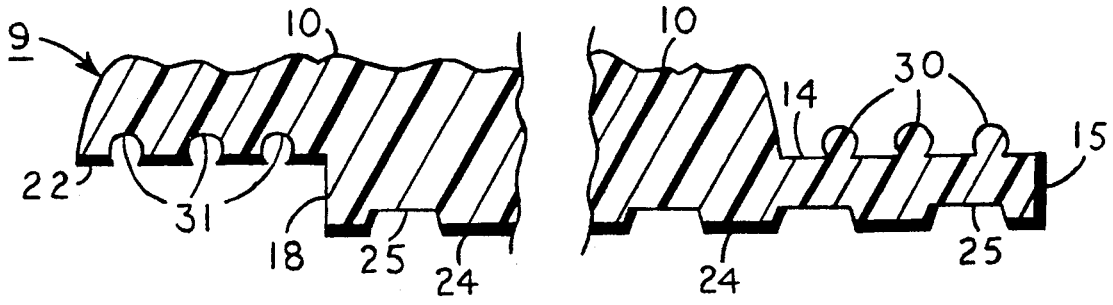
FIG. 3 is a false sectional view of an individual plastic shake with weather strip ridges and grooves.
Figure 4:
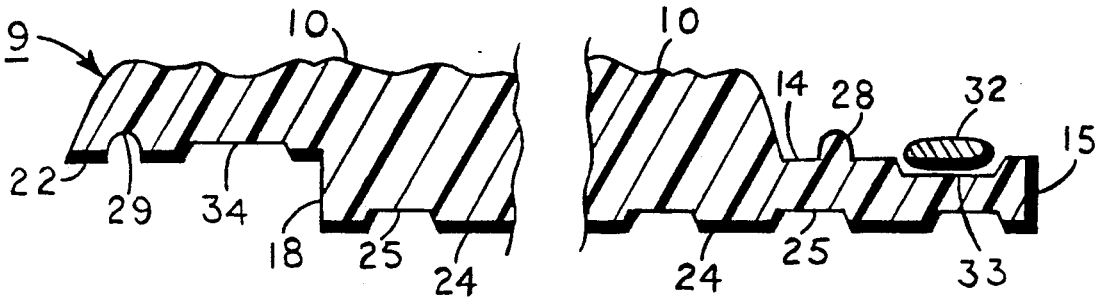
FIG. 4 is a false sectional view of an individual plastic shake with weather strip using mastic and a ridge and groove.

Second underlap surface 14 is the length wise edge surface forming a weather seal. Surface 14 can have a variety of weather seal configurations molded onto or into it such as the locator and weather seal ribs 28 shown in FIG. 1. Ribs 28 may terminate at the top parallel with joint 11 or transition point 27 and not extend onto surface 12. Ribs 28 may vary in length to the edge of tab 19 or end in line with butt edge 17. Ribs 28 will inter-lock or locate into grooves 29, FIG. 2. Ribs 28 are intended to provide an additional moisture barrier by reducing the wicking action of moisture. Variations of ribs 28 are shown in FIG. 3 where ribs 30 are snap fit into grooves 31. Additionally, a combination of a rib 28 may be used with a mastic 32 bonded in relief 33 as shown in FIG. 4, wherein rib 28 fits into groove 29 and mastic 32 bonds into relief 34. Another variation of FIG. 4 would be the elimination of rib 28 and groove 29 and just use mastic 32 bonded in relief 33 and subsequently into relief 34.

Figure 2:
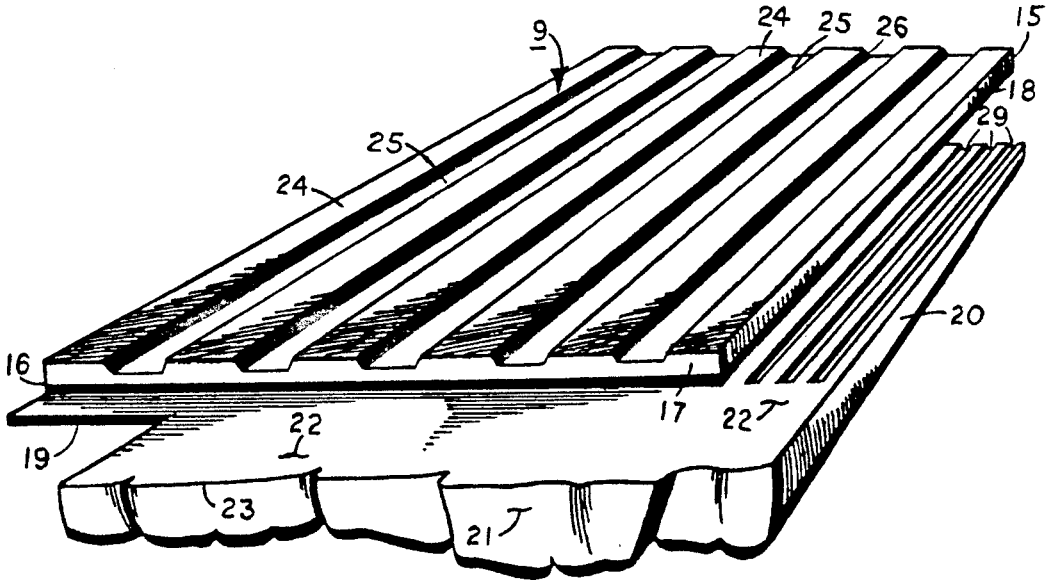
FIG. 2 is a perspective view of the underside of an individual plastic shake with venturi grooves and overlap area with weather strip grooves.

In the embodiment illustrated in FIG. 2, it will be seen that the design of venturi grooves 25 run parallel the full length of the bottom surface 24 of shake part number 9. The function of the venturi grooves 25 for air movement are detailed in the text of this invention. The venturi grooves 25 are an important aspect of the present invention as they align with venturi grooves 25 in the next row or course. The venturi grooves 25 are molded in surface 24 of part 9 with a beveled or rounded transition 26 from surface 24 to the recessed groove 25. The grooves 25 are spaced equal distance apart and when part 9 width is larger or smaller there will be either more or less of the number of grooves 25 in surface 24. When installing the shake part 9, the left edge of the overlapping course is to be parallel to the lower course and the venturi grooves 25 will automatically align with venturi grooves 25 in the course above.

Referring to FIG. 2, weather seal grooves 29 in overlap surface 22, the function of the same described above, can either terminate as illustrated or grooves 29 can continue to the edge of surface 21. The weather seal or locating grooves 29 can be replaced by various designs such as grooves 31, FIG. 3, or a combination of a single groove or the addition of a mastic 32 recession 34 as illustrated in FIG. 4.

Also illustrated in FIG. 2 is an overlap joint seal tab 19. Tab 19 is an extension of surface 14 and will cover small exposed butt joints between courses of shake parts.

The installation of this simulate, individual, self-venting, overlapping, plastic shake 9 invention is similar to standard construction practices of installing conventional roofing. Starting at the lower left, a row or course of shake parts 9 are secured with fasteners 13 through the first underlap surface 12 to the substrate. Alternating shake 9 widths, from one of many sizes, in a random selection will produce a non-repeating pattern, resembling natural wood shake construction. The second and subsequent courses are to be started from the left with the left edge of shake part 9 parallel to the lower course, this is imperative so the venturi grooves 25 align. The second course should be started with a shake part 9 that is not the same size as the shake part 9 below it. Selection of shake parts 9 should be made so not to allow two course butt seams to align parallel. The staggering of edge seams will improve the moisture barrier and provide for a more realistic appearance as with a wood shake roof installation.

When installing the first shake part 9, surface 24 is place on the weather seal felt or tar paper. The left edge 40 is aligned with the roof substrate, and once aligned fasteners 13 are driven through underlap surface 12. The second shake part 9 is placed next to the first with butt edge 16 contacting butt edge 18. The top edge 15 of both shake parts 9 should be parallel. Engaging ribs 28 into grooves 29 will additionally locate and align the shake parts 9. The second shake part 9 is then secured with fasteners 13 driven through underlap surface 12. The third and subsequent shake parts 9 randomly selected by their width are fitted and secured the same as the second shake part 9 was. When starting the second and subsequent courses the first overlap 22 will cover first underlap surface 12 and fasteners 13 heads. Front butt joint 17 will contact back or top butt joint 15 providing for self alignment off or course number one. Overlap joint seal tab 19 will bridge butt seam 15 forming a moisture barrier and will be additionally overlapped by first overlap surface 22 of the next shake part 9.

To construct a ridge cap or outside corner cap, select a shake part 9 with a textured top plate 10 that is wide enough to cover the desired area. Once the proper size shake part 9 is selected, then cut off the second underlap 14 lengthwise from butt joint 17 to butt joint 15. Cutting off second underlap 14 can be done with a saw or shear. Position the left side of shake part 9 cap first so that first overlap 22 extends beyond the roof line and secure shake part 9 with fasteners 13 driven through underlap 12. The left side of shake part 9 cap, with underlap surface 14 cut off, will go under and contact second overlap area 42 of the right side shake part 9 cap, thus forming a butt joint seal. To achieve a random non-repeating pattern for the ridge cap, select the succeeding shake part 9 cap from a larger shake part 9 and cut to the size of the first by cutting lengthwise through textured top plate 10 form front wall 21 to butt joint 15. Position the next course of cap so that the left side 40 is parallel to the first, overlapping first underlap 12 and fasteners 13 with second overlap surface 42 and secure with fasteners 13. Size and install the left side shake part 9 cap as before and continue the procedure for the balance of the ridge cap or outside corner.

There has thus been described and shown an improved simulated shake shingle which accomplishes at least all of the stated objectives.

I claim:

1. A simulated shake shingle for replicating the random appearance of natural wood shakes, said shingle comprising;

a generally rectangular top plate having forward and rearward ends, said top plate being rearwardly tapered;

a generally rectangular bottom plate secured to and partially underlying said top plate and being rearwardly and transversely offset therefrom; and said bottom plate being of size and shape for flush engagement against a flat roof surface and adapted for side to side engagement with bottom plates of six identical adjoining shingles positioned with the top plates thereof in adjacent nonoverlapping relation.

2. The simulated shake shingle of claim 1 wherein said bottom plate further includes an underside beneath and parallel to said top surface of said bottom plate, said underside including a plurality of generally parallel, upwardly recessed venturi grooves, said venturi grooves extending substantially the longitudinal length of said bottom plate.

3. The simulated shake shingle of claim 1 wherein said top plate further includes a textured top surface having an appearance similar to that of a natural wood shake shingle.

4. The simulated shake shingle of claim 1 wherein said bottom plate further comprises at least one nail hole formed in said bottom plate, said nail hole adapted to allow a nail to extend through the nail hole into a roof surface whereby said simulated shake shingle may be connected thereto.

5. The simulated shake shingle of claim 1 wherein said top plate further includes an underside and said bottom plate further includes a top surface, a portion of said top surface of said bottom plate secured to a portion of said underside of said top plate.

6. The simulated shake shingle of claim 5 wherein that portion of the underside of the top plate positioned forwardly of the bottom plate comprises a first mating overlap surface;

that portion of the underside of said top plate extending transversely of said bottom plate comprises a second mating overlap area;

that portion of the top surface of said bottom plate extending rearwardly of the top plate comprises a first underlap surface;

that portion of the top surface of said bottom plate positioned transversely of said top plate comprising a second underlap surface;

the first mating overlap surface being of a size and shape for engaging and substantially covering the first underlap surface of first and second adjacent shingles;

the second mating overlap surface being of a size and shape for engaging and covering a forward portion of the second underlap surface of a third adjacent shingle;

the first underlap surface adapted to be substantially covered by the first mating overlap surface of a fourth adjacent shingle; and the second underlap surface adapted to be substantially covered by the second mating overlap surfaces of a fifth and sixth adjacent shingles.

7. The simulated shake shingle of claim 6 wherein said second underlap surface further comprises seal means mounted thereon, said seal means operative to be interposed between said second mating overlap surface and the second underlap surface of an adjacent shingle for effecting a water-resistant seal therebetween.

8. The simulated shake shingle of claim 7 wherein said second mating overlap surface further comprises engagement means for engaging said seal means on said second underlap surface, said engagement means in combination with said seal means operative to effect increased water seepage resistance between said second mating overlap surface and said second underlap surface.

9. The simulated shake shingle of claim 8 wherein said seal means comprises a plurality of generally parallel raised ribs formed and extending longitudinally on said underlap surface and said securement means comprises a plurality of parallel rib-receiving grooves formed in said second mating overlap surface, said rib-receiving grooves extending longitudinally on said second mating overlap surface and adapted to accept said ribs therein such that an improved water seepage resistant seal is formed.

10. The simulated shake shingle of claim 8 wherein said seal means comprises a recessed relief channel having a mastic bonded therein and said securement means in said second mating overlap surface comprises a recessed relief channel for receiving said mastic therein such that upon adjacent shingles being positioned such that said second mating overlap surface of one shingle overlies said second underlap surface of an adjacent shingle, said mastic in said recessed relief channel forms a generally water tight seal between said second mating overlap surface and said second underlap surface.

* * * * *